US009389626B2

(12) United States Patent
Kim et al.

(10) Patent No.: US 9,389,626 B2
(45) Date of Patent: Jul. 12, 2016

(54) LOW-DROP-OUTPUT TYPE VOLTAGE REGULATOR AND RF SWITCHING CONTROL DEVICE HAVING THE SAME

(71) Applicant: SAMSUNG ELECTRO-MECHANICS CO., LTD., Suwon-Si (KR)

(72) Inventors: Yoo Hwan Kim, Suwon-Si (KR); Jong Myeong Kim, Suwon-Si (KR); Hyun Hwan Yoo, Suwon-Si (KR); Yoo Sam Na, Suwon-Si (KR); Dae Seok Jang, Suwon-Si (KR); Hyun Jin Yoo, Suwon-Si (KR)

(73) Assignee: Samsung Electro-Mechanics Co., Ltd., Suwon-si (KR)

( * ) Notice: Subject to any disclaimer, the term of this patent is extended or adjusted under 35 U.S.C. 154(b) by 0 days.

(21) Appl. No.: 14/670,964

(22) Filed: Mar. 27, 2015

(65) Prior Publication Data

US 2016/0062376 A1 Mar. 3, 2016

(30) Foreign Application Priority Data

Sep. 1, 2014 (KR) ..... 10-2014-0115663

(51) Int. Cl.
*G05F 1/575* (2006.01)

(52) U.S. Cl.
CPC ..... *G05F 1/575* (2013.01)

(58) Field of Classification Search
CPC ..... G05F 1/46; G05F 1/613
See application file for complete search history.

(56) References Cited

U.S. PATENT DOCUMENTS 5,528,127 A * 6/1996 Streit ..... G05F 1/565 323/269
7,126,513 B1 * 10/2006 Zinn ..... G06F 1/22 341/139
7,218,168 B1 * 5/2007 Rahman ..... G05F 1/56 323/273
7,701,690 B1 * 4/2010 Li ..... G05F 1/56 361/159
7,915,961 B1 * 3/2011 Li ..... H03F 1/0261 330/297
8,072,196 B1 * 12/2011 Li ..... G05F 1/56 323/266
8,134,349 B2 * 3/2012 Shiga ..... G05F 1/56 323/224
8,401,500 B1 * 3/2013 Bauder ..... G06F 1/26 330/127

(Continued)

FOREIGN PATENT DOCUMENTS

JP 2001-175341 A 6/2001
JP 2007-304850 A 11/2007

*Primary Examiner* — Timothy J Dole
*Assistant Examiner* — Yusef Ahmed
(74) *Attorney, Agent, or Firm* — NSIP Law

(57) ABSTRACT

A low-drop-output type voltage regulator may include an error amplifier providing a gate signal depending on a voltage difference between a reference voltage and a feedback voltage, a semiconductor switch adjusting a current between an input terminal receiving a battery voltage and a ground, in response to the gate signal, a feedback circuit dividing and detecting a detection voltage in a detection node between the semiconductor switch and the ground and providing the feedback voltage, a voltage sensor sensing the battery voltage, and a feedback voltage controller adjusting a level of the feedback voltage depending on the sensed battery voltage.

16 Claims, 6 Drawing Sheets

(56) References Cited

U.S. PATENT DOCUMENTS 8,547,077 B1 * 10/2013 Chang ..... G05F 1/575 323/275
8,674,672 B1 * 3/2014 Johal ..... G05F 1/565 323/275
2002/0171403 A1 * 11/2002 Lopata ..... H03F 3/45183 323/280
2005/0057468 A1 * 3/2005 Yamamoto ..... G09G 3/36 345/87
2006/0170401 A1 * 8/2006 Chen ..... G05F 1/575 323/273
2007/0018623 A1 * 1/2007 Lopata ..... G05F 1/575 323/282
2007/0159146 A1 * 7/2007 Mandal ..... G05F 1/575 323/280
2007/0210770 A1 * 9/2007 Dean ..... G05F 1/46 323/273
2008/0231243 A1 * 9/2008 Zhong ..... G05F 1/56 323/273
2009/0079406 A1 * 3/2009 Deng ..... G05F 1/565 323/280
2009/0212753 A1 * 8/2009 Lou ..... G05F 1/563 323/277
2009/0302812 A1 * 12/2009 Shor ..... G05F 1/563 323/223
2010/0026250 A1 * 2/2010 Petty ..... H02M 3/156 323/271
2010/0134085 A1 * 6/2010 Nishida ..... H02M 3/1563 323/285
2010/0259235 A1 * 10/2010 Ozalevli ..... G05F 1/56 323/274
2011/0062925 A1 * 3/2011 Han ..... G09G 3/3696 323/282
2011/0181348 A1 * 7/2011 Ashida ..... G05F 1/565 327/541
2012/0187930 A1 * 7/2012 Williams ..... G05F 1/5735 323/273
2013/0021099 A1 * 1/2013 Berchtold ..... H03F 1/0238 330/254
2013/0076323 A1 * 3/2013 Huang ..... G05F 1/46 323/274
2013/0127548 A1 * 5/2013 Popplewell ..... H03F 1/0227 330/297
2013/0135043 A1 * 5/2013 Hietala ..... H03F 1/0277 330/124 R
2013/0141063 A1 * 6/2013 Kay ..... G05F 1/468 323/271
2013/0141068 A1 * 6/2013 Kay ..... G05F 1/46 323/282
2013/0307576 A1 * 11/2013 Ilkov ..... G01R 31/2621 324/762.02
2014/0176098 A1 * 6/2014 Fang ..... G05F 1/575 323/280
2014/0210436 A1 * 7/2014 Zhong ..... H02M 3/07 323/271
2014/0266118 A1 * 9/2014 Chern ..... H02M 3/156 323/283
2014/0312870 A1 * 10/2014 Imayoshi ..... H02M 3/156 323/284
2015/0097534 A1 * 4/2015 Bhattad ..... G05F 1/462 323/270
2015/0130292 A1 * 5/2015 Yeon ..... G05F 1/62 307/104

* cited by examiner

LOW-DROP-OUTPUT TYPE VOLTAGE REGULATOR AND RF SWITCHING CONTROL DEVICE HAVING THE SAME

CROSS-REFERENCE TO RELATED APPLICATION

This application claims priority to, and the benefit of, Korean Patent Application No. 10-2014-0115663 filed on Sep. 1, 2014, with the Korean Intellectual Property Office, the disclosure of which is incorporated herein by reference.

BACKGROUND

The present disclosure relates to a low-drop-output type voltage regulator and a radio frequency (RF) switching control device having the same.

In general, a switching control device that outputs a switching control signal to a radio frequency (RF) switch used for a RF antenna device of a mobile communications terminal may use a voltage regulator to stably control the switching control signal.

Particularly, among voltage regulators, a low-drop-output (LDO) type voltage regulator may down-convert a source voltage, be simply designed, and decrease current consumption.

The amplitude of the switching control signal of the switching control device using the above-mentioned LDO depends on an output voltage of the LDO and the output voltage of the LDO is determined based on a minimum value of the range of a battery voltage. That is, the amplitude of the switching control signal may not be higher than the output voltage of the LDO.

However, since linear performance of the RF switch is increased as a gate control voltage, that is, the amplitude of the switching control signal is increased, a voltage regulator capable of varying the output voltage depending on the battery voltage has been required.

SUMMARY

An exemplary embodiment in the present disclosure may provide a low-drop-output type voltage regulator capable of adjusting an output voltage by sensing a battery voltage and adjusting a feedback voltage depending on the sensed battery voltage.

An exemplary embodiment in the present disclosure may also provide a radio frequency (RF) switching control device capable of securing linear characteristics of a RF switch receiving a switching control voltage by adjusting the switching control voltage using an output voltage which is adjusted depending on a battery voltage.

According to an exemplary embodiment in the present disclosure, a low-drop-output type voltage regulator may include an error amplifier providing a gate signal depending on a voltage difference between a reference voltage and a feedback voltage, a semiconductor switch adjusting a current between an input terminal receiving a battery voltage and a ground, in response to the gate signal, a feedback circuit dividing and detecting a detection voltage in a detection node between the semiconductor switch and the ground and providing the feedback voltage. a voltage sensor sensing the battery voltage, and a feedback voltage controller adjusting a level of the feedback voltage depending on the sensed battery voltage.

The feedback circuit may include a first detection resistor and a second detection resistor that are connected between the detection node and the ground, and provide the feedback voltage at feedback nodes of the first detection resistor and the second detection resistor.

The first detection resistor may be a potentiometer, and the feedback voltage controller may adjust the feedback voltage by varying a resistance value of the first detection resistor.

According to an exemplary embodiment in the present disclosure, a radio frequency switching control device may include a low-drop-output type voltage regulator sensing a battery voltage and adjusting an output voltage depending on the sensed battery voltage, and a switching controller outputting an on or off signal to a radio frequency switch using the output voltage.

BRIEF DESCRIPTION OF DRAWINGS

The above and other aspects, features and other advantages of the present disclosure will be more clearly understood from the following detailed description taken in conjunction with the accompanying drawings, in which.

DETAILED DESCRIPTION

Figure 1:
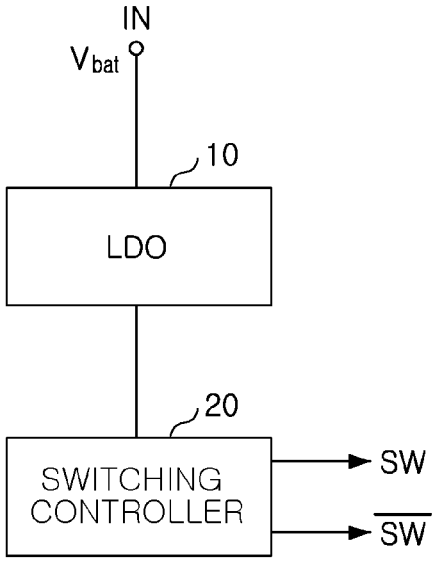
FIG. 1 is a configuration diagram for describing a radio frequency (RF) switching control device according to an exemplary embodiment in the present disclosure.

Exemplary embodiments of the present disclosure will now be described in detail with reference to the accompanying drawings.

The disclosure may, however, be embodied in many different forms and should not be construed as being limited to the embodiments set forth herein. Rather, these embodiments are provided so that this disclosure will be thorough and complete, and will fully convey the scope of the disclosure to those skilled in the art.

In the drawings, the shapes and dimensions of elements may be exaggerated for clarity, and the same reference numerals will be used throughout to designate the same or like elements.

FIG. 1 is a configuration diagram for describing a radio frequency (RF) switching control device according to an exemplary embodiment of the present disclosure.

Referring to FIG. 1, a radio frequency (RF) switching control device according to an exemplary embodiment of the present disclosure may include a voltage regulator 10 of a low-drop-output type and a switching controller 20.

The voltage regulator 10 of the low-drop-output type may sense the battery voltage Vbat and may adjust an output voltage Vout depending on the sensed battery voltage Vbat.

According to an exemplary embodiment, the voltage regulator 10 of the low-drop-output type may include an error amplifier 100, a semiconductor switch 200, a feedback circuit 300, a voltage sensor 400, and a feedback voltage controller 500.

The voltage regulator 10 of the low-drop-output type will be described below in more detail with reference to FIG. 2.

The switching controller 20 may output switching controlling signals SW and SW(−) using the output voltage Vout. The switching controlling signals SW and SW(−) each may be an on or off signal, and the SW signal and the SW(−) signal may be signals that are opposite to each other.

Figure 2:
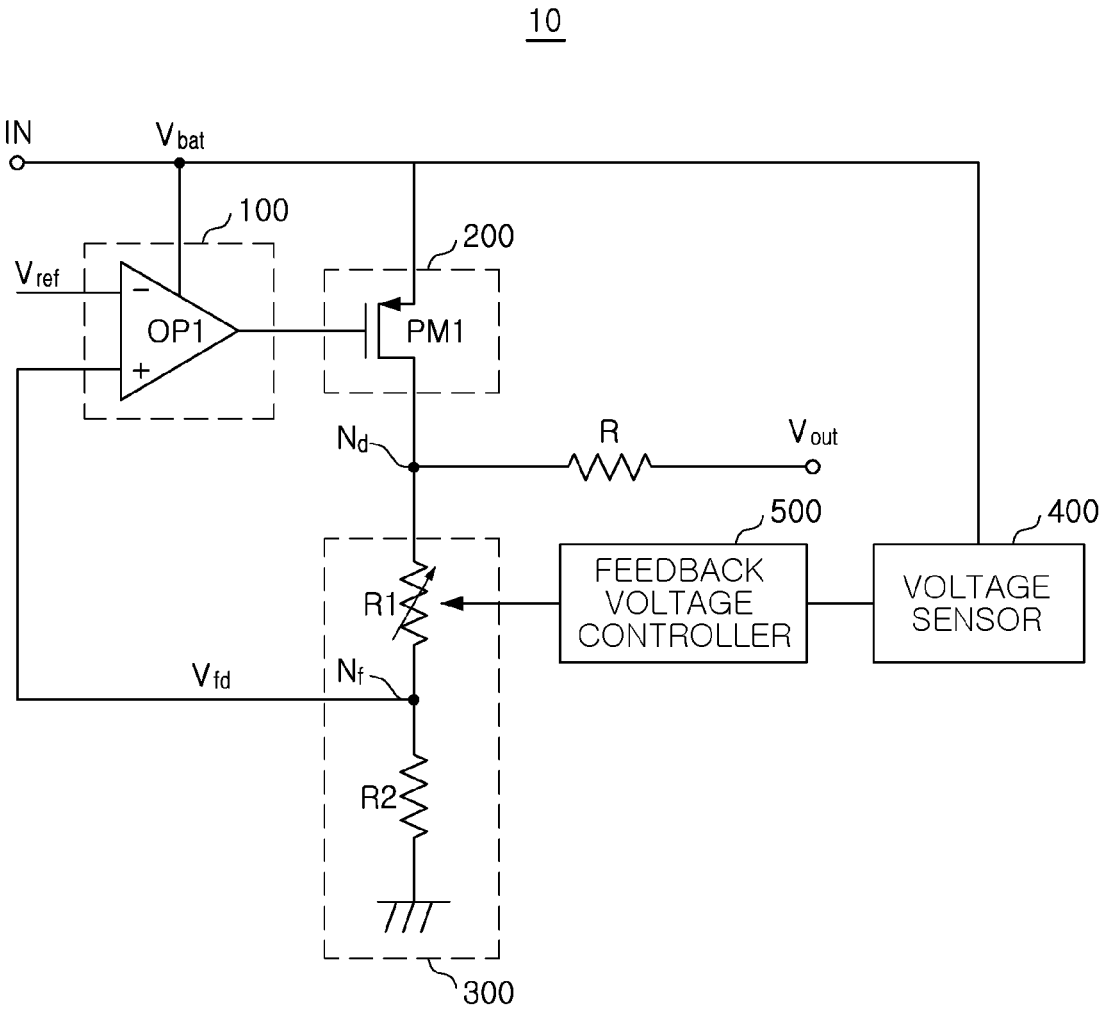
FIG. 2 is a diagram for describing a low-drop-output type voltage regulator according to an exemplary embodiment in the present disclosure.
Figure 3:
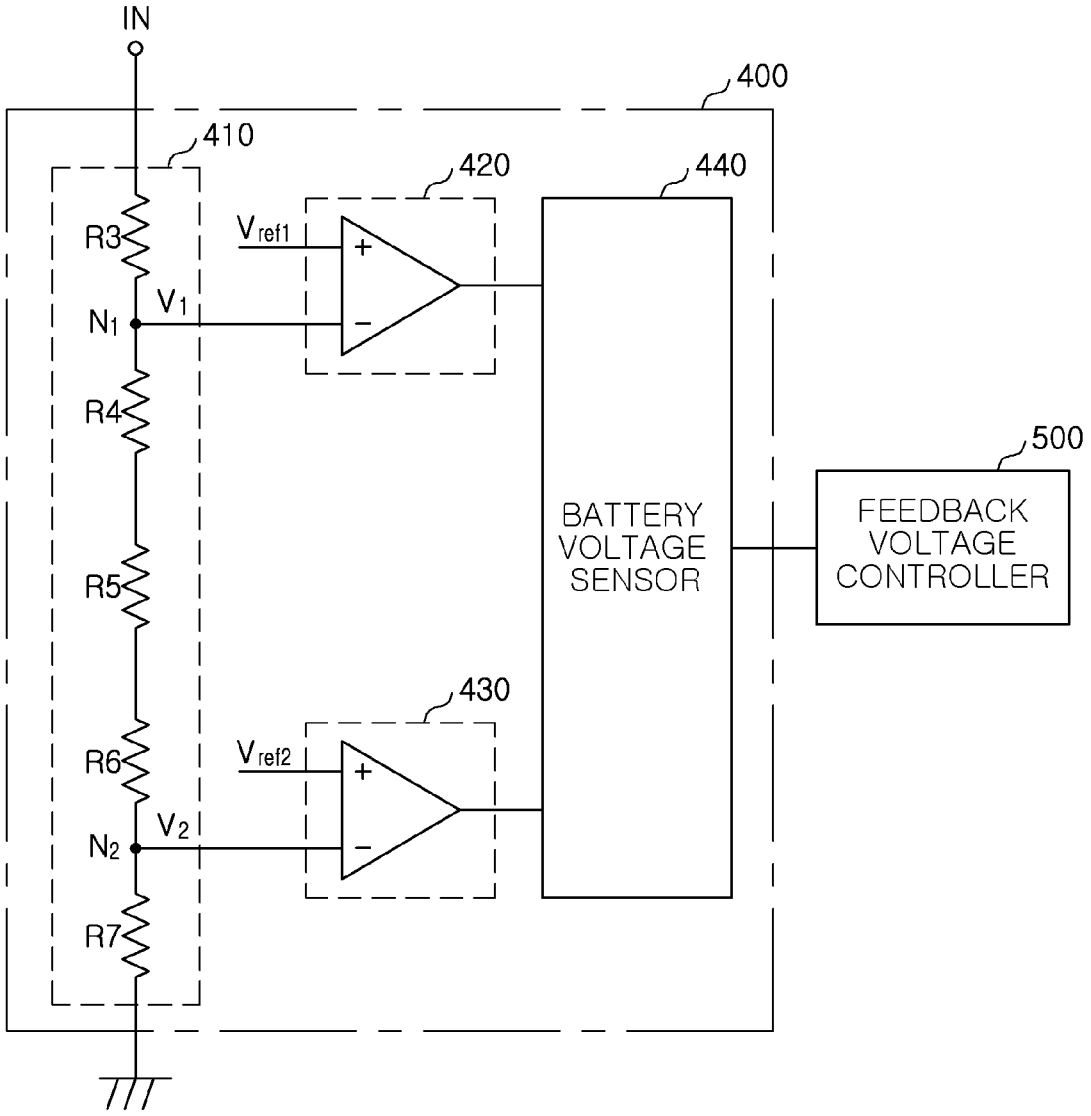
FIG. 3 is a diagram for describing an example of a voltage sensor of FIG. 2.

FIG. 2 is a diagram for describing a low-drop-output type voltage regulator according to an exemplary embodiment of the present disclosure and FIG. 3 is a diagram for describing an example of a voltage sensor of FIG. 2.

Referring to FIG. 2, the voltage regulator 10 of the low-drop-output type according to an exemplary embodiment may include the error amplifier 100, the semiconductor switch 200, the feedback circuit 300, the voltage sensor 400, and the feedback voltage controller 500.

The error amplifier 100 may provide a gate signal SG to the semiconductor switch 200, depending on a difference voltage between a reference voltage Vref and a feedback voltage Vfb.

According to an exemplary embodiment, the error amplifier 100 may include an operational amplifier OP1 having an inverting input terminal receiving the reference voltage Vref, a non-inverting input terminal receiving the feedback voltage Vfb, and an output terminal connected to the semiconductor switch 200 in order to control the gate signal SG.

In this case, the operational amplifier OP1 may control the reference voltage Vref and the feedback voltage Vfb so as to be same as each other by providing the gate signal SG having a level corresponding to the difference voltage between the reference voltage Vref and the feedback voltage Vfb.

The semiconductor switch 200 may adjust a current between the input terminal IN receiving the battery voltage Vbat and a ground, depending on the gate signal SG.

According to an exemplary embodiment, the semiconductor switch 200 may include a first PMOS transistor PM1 having a source connected to the input terminal IN, a gate connected to an output terminal of the error amplifier 100, and a drain connected to the feedback circuit 300.

In this case, the PMOS transistor PM1 may adjust a source-drain current depending on the gate signal SG.

The feedback circuit 300 may divide and detect a detection voltage in a detection node Nd between the semiconductor switch 200 and the ground, so as to provide the feedback voltage Vfd to the error amplifier 100.

According to an exemplary embodiment, the feedback circuit 300 may include a first detection resistor R1 and a second detection resistor R2 that are connected between the detection node Nd and the ground.

Here, if resistance values of the first detection resistor R1 and the second detection resistor R2 are set to be same as each other, the feedback voltage Vfb may correspond to a half of a detection voltage Vdet. That is, the detection voltage Vdet may be two times voltage of the feedback voltage Vfb.

According to an exemplary embodiment, the first detection resistor R1 may be a potentiometer and the resistance value of the first detection resistor R1 may be adjusted by the feedback voltage controller 500.

According to another exemplary embodiment, although not shown in the drawings, the second detection resistor R2 may be a potentiometer and the resistance value of the second detection resistor R2 may be adjusted by the feedback voltage controller 500.

The voltage sensor 400 may sense the battery voltage Vbat. According to an exemplary embodiment, the voltage sensor 400 may include a plurality of resistors 410 connected between the input terminal IN and the ground, a plurality of comparing units 420 and 430 each comparing voltages of a plurality of nodes between the plurality of resistors with a comparison voltage, and a battery voltage sensor 440 sensing the battery voltage Vbat based on the comparison results of the plurality of comparing units 420 and 430, as shown in FIG. 3.

The plurality of resistors 410 may be connected between the input terminal IN and the ground. The plurality of comparing units 420 and 430 each may compare the voltages of the plurality of nodes between the plurality of resistors with the comparison voltage.

According to an exemplary embodiment, the plurality of comparing units 420 and 430 may include a first comparing unit 420 comparing a first voltage V1 of a first node N1 among the nodes between the plurality of resistors with a first comparison voltage Vref1 which is preset and outputting the comparison result and a second comparing unit 430 comparing a second voltage V2 of a second node N2 among the nodes between the plurality of resistors with a second comparison voltage Vref2 which is preset and outputting the comparison result.

The battery voltage sensor 440 may sense the battery voltage Vbat depending on the comparison results of the plurality of comparing units 420 and 430.

The feedback voltage controller 500 may adjust the feedback voltage Vfb depending on the battery voltage Vbat sensed by the voltage sensor 400.

According to an exemplary embodiment, when the sensed battery voltage Vbat is larger than the reference voltage when the battery voltage Vbat sensed by the voltage sensor 400 is compared with a preset reference voltage, the feedback voltage controller 500 may decrease the feedback voltage Vfb by increasing the resistance value of the first detection resistor R1.

In the case in which the feedback voltage Vfb is decreased, since the gate signal SG output from the error amplifier 100 is increased, the output voltage Vout may be increased.

Figure 4:
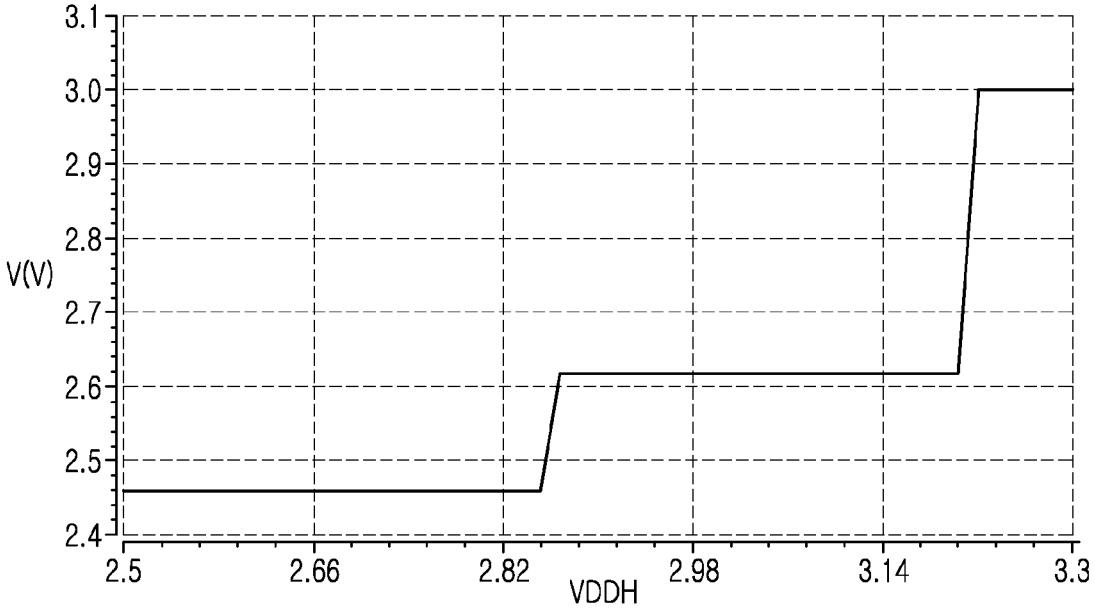
FIG. 4 is a graph for describing an output voltage of the voltage regulator of the low-drop-output type of FIG. 3 depending on a level of a battery voltage.
Figure 5:
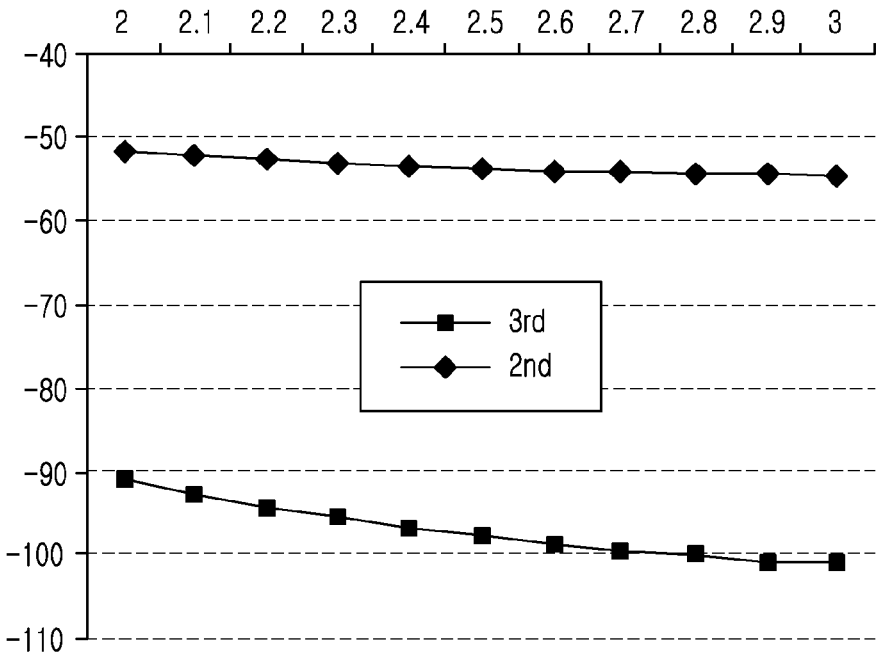
FIG. 5 is a graph for describing linear characteristics of a RF switch depending on a switch on signal output from the RF switching control device of FIG. 1.
Figure 6:
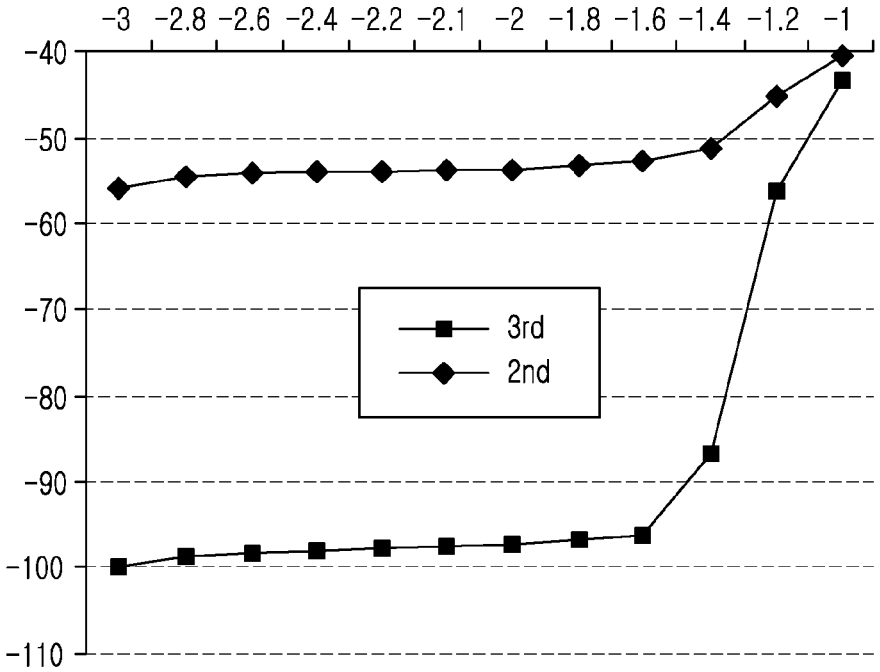
FIG. 6 is a graph for describing linear characteristics of a RF switch depending on a switch off signal output from the RF switching control device of FIG. 1.

FIG. 4 is a graph for describing an output voltage of the voltage regulator of the low-drop-output type of FIG. 3 depending on a level of a battery voltage, FIG. 5 is a graph for describing linear characteristics of a RF switch depending on a switch on signal output from the RF switching control device of FIG. 1, and FIG. 6 is a graph for describing linear characteristics of a RF switch depending on a switch off signal output from the RF switching control device of FIG. 1.

In FIG. 4, a horizontal axis shows the battery voltage Vbat input to the input terminal IN and a vertical axis shows the output voltage Vout. The voltage regulator of the low-drop-output type according to an exemplary embodiment of the present disclosure may obtain the output voltage Vout depending on the battery voltage Vbat as shown in FIG. 4, by adjusting the resistance value of the first detection resistor R1 depending on the sensed battery voltage Vbat according to the comparison results of the plurality of comparing units 420 and 430 so as to adjust the feedback voltage Vfb.

FIGS. 5 and 6 are the graphs showing linear characteristics of the RF switch in which the RF switching control device of FIG. 1 is used. Here, FIG. 5 shows linear characteristics depending on the switching control voltage SW in the case in which a switch of the RF switch is turned on, and FIG. 6 shows linear characteristics depending on the switching control voltage $\overline{SW}$ in the case in which a switch of the RF switch is turned off. The voltage regulator of the low-drop-output type adjusts the output voltage depending on the battery voltage and consequently, the switching control voltages SW and SW of the switching controller are adjusted, whereby the RF switching control device according to an exemplary embodiment of the present disclosure may secure linear characteristics of the RF switch receiving the switching control voltages SW and SW.

As set forth above, according to exemplary embodiments of the present disclosure, the output voltage may be adjusted by sensing the battery voltage and adjusting a level of the feedback voltage depending on the sensed battery voltage.

In addition, linear characteristics of the RF switch receiving the switching control voltage may be secured by adjusting the switching control voltage using the output voltage which is adjusted depending on the battery voltage.

While exemplary embodiments have been shown and described above, it will be apparent to those skilled in the art that modifications and variations could be made without departing from the scope of the present invention as defined by the appended claims.

What is claimed is:

1. A low-drop-output type voltage regulator comprising:

an error amplifier configured to provide a gate signal depending on a voltage difference between a reference voltage and a feedback voltage;

a semiconductor switch configured to adjust a current between an input terminal receiving a battery voltage in response to the gate signal and a ground;

a feedback circuit configured to divide and detect a detection voltage in a detection node between the semiconductor switch and the ground and providing the feedback voltage;

a voltage sensor configured to sense the battery voltage; and a feedback voltage controller configured to adjust a level of the feedback voltage depending on the sensed battery voltage, wherein the feedback voltage controller decreases the feedback voltage when the battery voltage is increased, and increases the feedback voltage when the battery voltage is decreased.

2. The voltage regulator of claim 1, wherein the error amplifier includes an operational amplifier having an inverting input terminal receiving the reference voltage, a non-inverting input terminal receiving the feedback voltage, and an output terminal connected to the semiconductor switch in order to provide the gate signal, and the gate signal has a level corresponding to a level of a difference voltage between the reference voltage and the feedback voltage.

3. The voltage regulator of claim 1, wherein the semiconductor switch includes a PMOS transistor having a source connected to the input terminal, a gate connected to an output terminal of the error amplifying unit, and a drain connected to the feedback circuit, and the PMOS transistor adjusts a source-drain current in response to the gate signal.

4. The voltage regulator of claim 1, wherein the feedback circuit includes a first detection resistor and a second detection resistor that are connected between the detection node and the ground, and provides the feedback voltage at feedback nodes of the first detection resistor and the second detection resistor.

5. The voltage regulator of claim 4, wherein the first detection resistor is a potentiometer, and the feedback voltage controller adjusts the feedback voltage by varying a resistance value of the first detection resistor.

6. The voltage regulator of claim 5, wherein the feedback voltage controller decreases the feedback voltage by increasing the resistance value of the first detection resistor when the battery voltage is increased.

7. The voltage regulator of claim 5, wherein the feedback voltage controller increases the feedback voltage by decreasing the resistance value of the first detection resistor when the battery voltage is decreased.

8. The voltage regulator of claim 1, wherein the voltage sensor includes:

a plurality of resistors connected between the input terminal and the ground;

a first comparator configured to compare a first voltage of a first node among nodes between the plurality of resistors with a first comparison voltage;

a second comparator configured to compare a second voltage of a second node among the nodes between the plurality of resistors with a second comparison voltage; and a battery voltage sensor configured to sense the battery voltage depending on the comparison results of the first comparator and the second comparator.

9. A radio frequency switching control device comprising:

a low-drop-output type voltage regulator configured to sense a battery voltage and adjusting an output voltage depending on the sensed battery voltage; and a switching controller configured to output an on or off signal to a radio frequency switch using the output voltage, wherein the low-drop-output type voltage regulator includes:

an error amplifier configured to provide a gate signal depending on a voltage difference between a reference voltage and a feedback voltage;

a semiconductor switch configured to adjust a current between an input terminal receiving a battery voltage and a ground, in response to the gate signal;

a feedback circuit configured to divide and detecting a detection voltage in a detection node between the semiconductor switch and the ground and providing the feedback voltage;

a voltage dropping unit connected between the detection node and an output terminal and configured to drop an output voltage depending on an output current provided to the output terminal;

a voltage sensor configured to sense the battery voltage; and a feedback voltage controller configured to adjust a level of the feedback voltage depending on the sensed battery voltage, and wherein the feedback voltage controller decreases the feedback voltage when the battery voltage is increased, and increases the feedback voltage when the battery voltage is decreased.

10. The radio frequency switching control device of claim 9, wherein the error amplifier includes an operational amplifier having an inverting input terminal receiving the reference voltage, a non-inverting terminal receiving the feedback voltage, and an output terminal connected to the semiconductor switch to provide the gate signal, and the gate signal has a level corresponding to a level of a difference voltage between the reference voltage and the feedback voltage.

11. The radio frequency switching control device of claim 9, wherein the semiconductor switch includes a PMOS transistor having a source connected to the input terminal, a gate connected to an output terminal of the error amplifying unit, and a drain connected to the feedback circuit, and the PMOS transistor adjusts a source-drain current in response to the gate signal.

12. The radio frequency switching control device of claim 9, wherein the feedback circuit includes a first detection resistor and a second detection resistor that are connected between the detection node and the ground, and provides the feedback voltage at feedback nodes of the first detection resistor and the second detection resistor.

13. The radio frequency switching control device of claim 12, wherein the first detection resistor is a potentiometer, and the feedback voltage controller adjusts the feedback voltage by varying a resistance value of the first detection resistor.

14. The radio frequency switching control device of claim 13, wherein the feedback voltage controller decreases the feedback voltage by increasing the resistance value of the first detection resistor when the battery voltage is increased.

15. The radio frequency switching control device of claim 13, wherein the feedback voltage controller increases the feedback voltage by decreasing the resistance value of the first detection resistor when the battery voltage is decreased.

16. The radio frequency switching control device of claim 9, wherein the voltage sensor includes:

a plurality of resistors connected between the input terminal and the ground;

a first comparator comparing a first voltage of a first node among nodes between the plurality of resistors with a first comparison voltage;

a second comparator comparing a second voltage of a second node among the nodes between the plurality of resistors with a second comparison voltage; and a battery voltage sensor sensing the battery voltage depending on the comparison results of the first comparator and the second comparator.

* * * * *